US007347718B2

(12) United States Patent
Donhauser et al.

(10) Patent No.: US 7,347,718 B2
(45) Date of Patent: Mar. 25, 2008

(54) CONNECTOR MEANS FOR ELECTRICAL APPARATUS, PARTICULARLY PLUGS

(75) Inventors: Peter Donhauser, Amberg (DE); Walter Hanning, Detmold (DE); Klaus Wohlgemuth, Lemgo (DE); Volker Schröder, Lemgo (DE); Ulrich Lütkemeyer, Detmold (DE); Klaus-Dieter Endres, Maintal (DE); Herbert Fricke, Detmold (DE); Torsten Diekmann, Leopoldshöhe (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/657,904

(22) Filed: Jan. 25, 2007

(65) Prior Publication Data

US 2007/0190844 A1 Aug. 16, 2007

(30) Foreign Application Priority Data

Feb. 3, 2006 (DE) ..... 20 2006 001 710 U
Aug. 19, 2006 (DE) ..... 20 2006 012 799 U

(51) Int. Cl.
*H01R 4/24* (2006.01)

(52) U.S. Cl. ..... 439/417; 439/404

(58) Field of Classification Search ..... 439/395, 439/409, 410, 709, 417, 396, 404, 405, 411
See application file for complete search history.

(56) References Cited

U.S. PATENT DOCUMENTS 6,152,760 A * 11/2000 Reeser ..... 439/409
6,406,324 B1 * 6/2002 Duesterhoeft et al. ..... 439/409
2005/0245140 A1 * 11/2005 Ziemke et al. ..... 439/709

FOREIGN PATENT DOCUMENTS

| | | | |
|---|---|---|---|
| DE | 198 25 628 | C1 | 9/1999 |
| DE | 199 56 750 | A1 | 6/2000 |
| DE | 100 36 718 | A1 | 2/2002 |
| DE | 100 39 962 | A1 | 3/2002 |
| DE | 100 57 428 | A1 | 6/2002 |
| DE | 20 2004 013 363 | U1 | 10/2005 |
| EP | 0 936 697 | A1 | 8/1999 |
| EP | 1 191 633 | A2 | 3/2002 |
| EP | 1 191 634 | A2 | 3/2002 |
| EP | 1 286 421 | A2 | 2/2003 |
| EP | 1 443 600 | A1 | 8/2004 |

* cited by examiner

*Primary Examiner*—Tulsidas C. Patel
*Assistant Examiner*—Harshad C Patel
(74) *Attorney, Agent, or Firm*—Lawrence E. Laubscher, Sr.; Lawrence E. Laubscher, Jr.

(57) ABSTRACT

A connector arrangement includes a housing containing at least one open-topped chamber in which is mounted a stationary upwardly-directed knife device, and a rectangular carrier member arranged for downward insertion within the chamber, thereby to displace an insulated wire supported by the carrier member toward a position in which the knife device pierces the insulation layer and is brought into electrical engagement with the conductor contained therein. The carrier member includes a top surface containing a slot for receiving the tip of an operating tool that displaces the carrier member downwardly in the chamber, and a side wall containing at least one lug and slot arrangement by means of which the carrier member may be upwardly displaced upon lever-like operation of the tool in cooperation with a side wall of the chamber. Preferably, the housing includes a plurality of the chambers arranged in one or more rows.

15 Claims, 9 Drawing Sheets

Fig. 3a
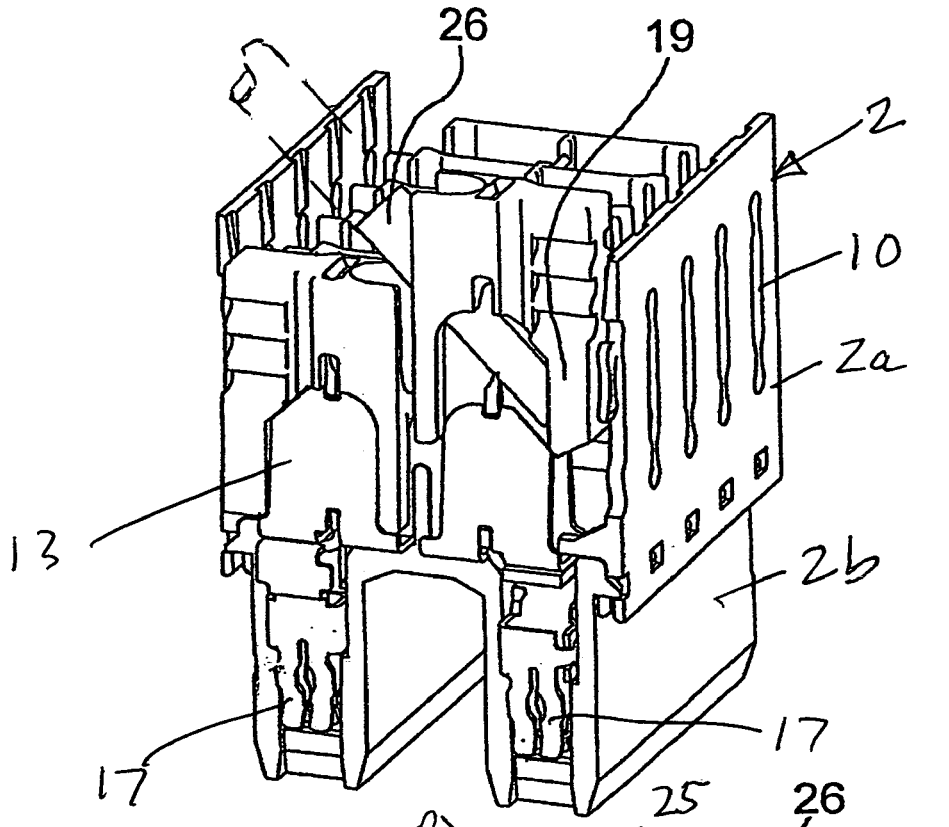
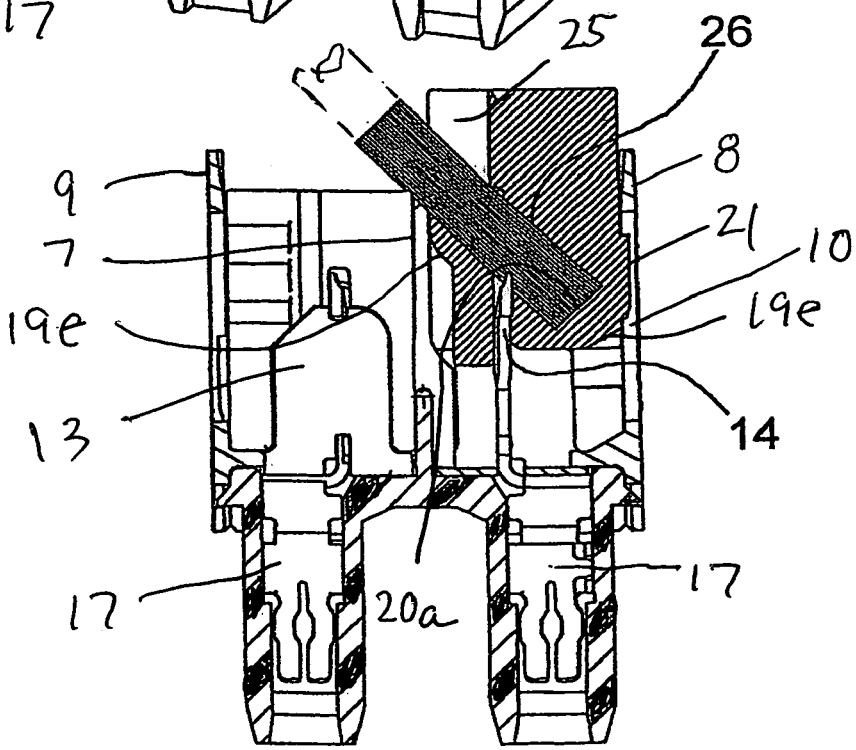
Fig. 3b

Fig. 4a
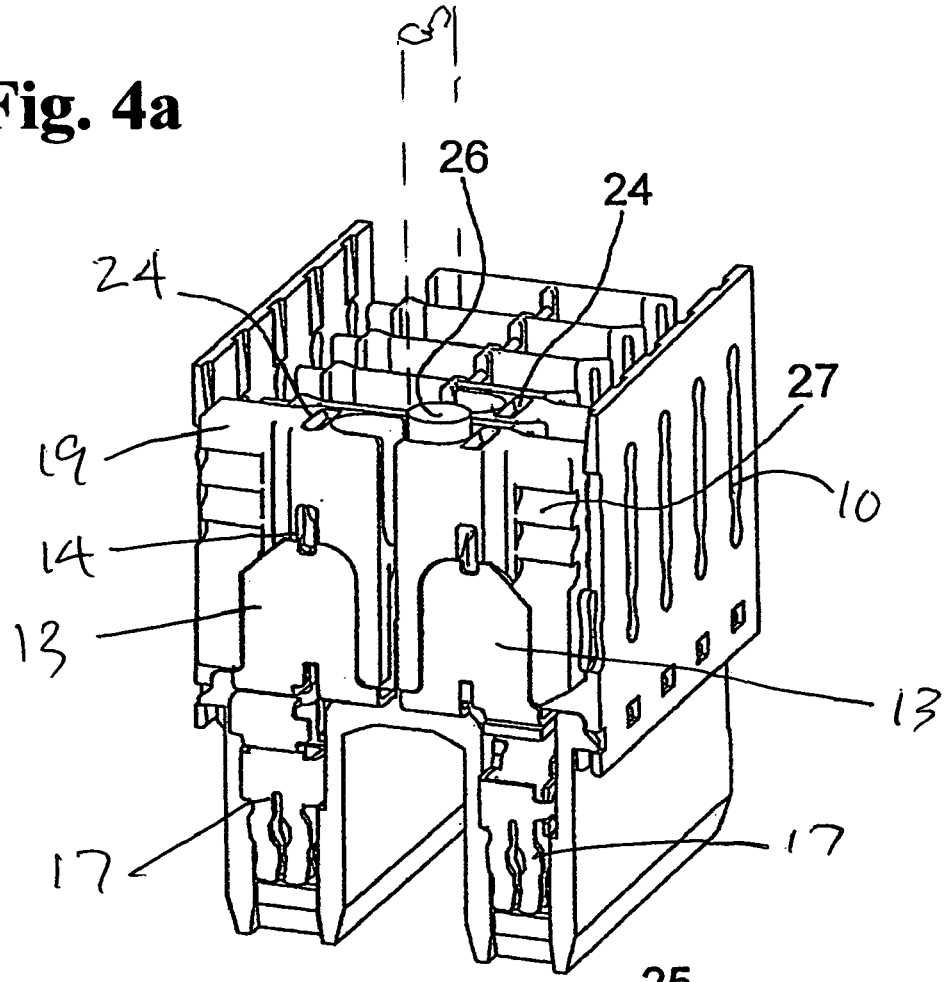
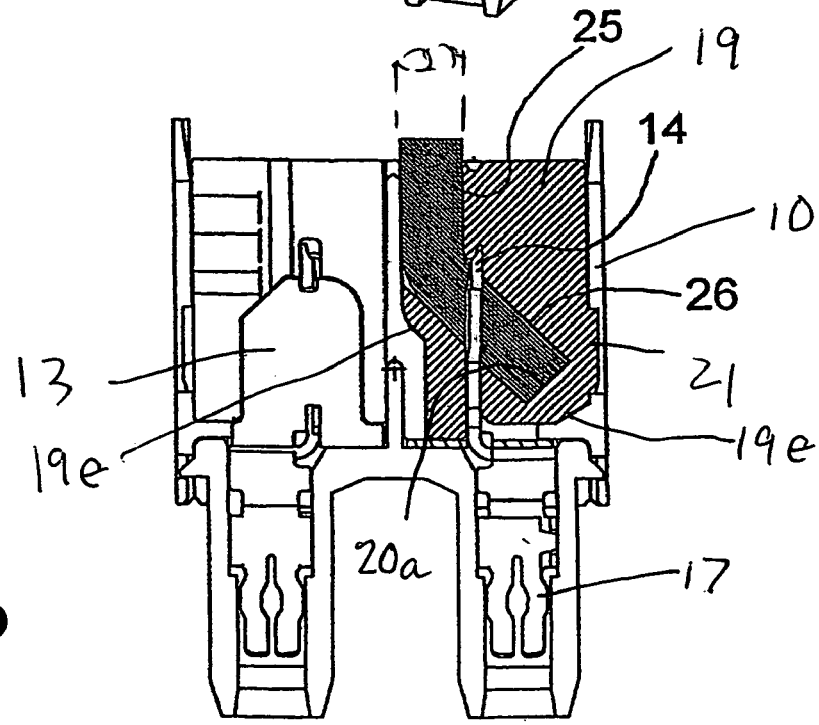
Fig. 4b

Fig. 7a
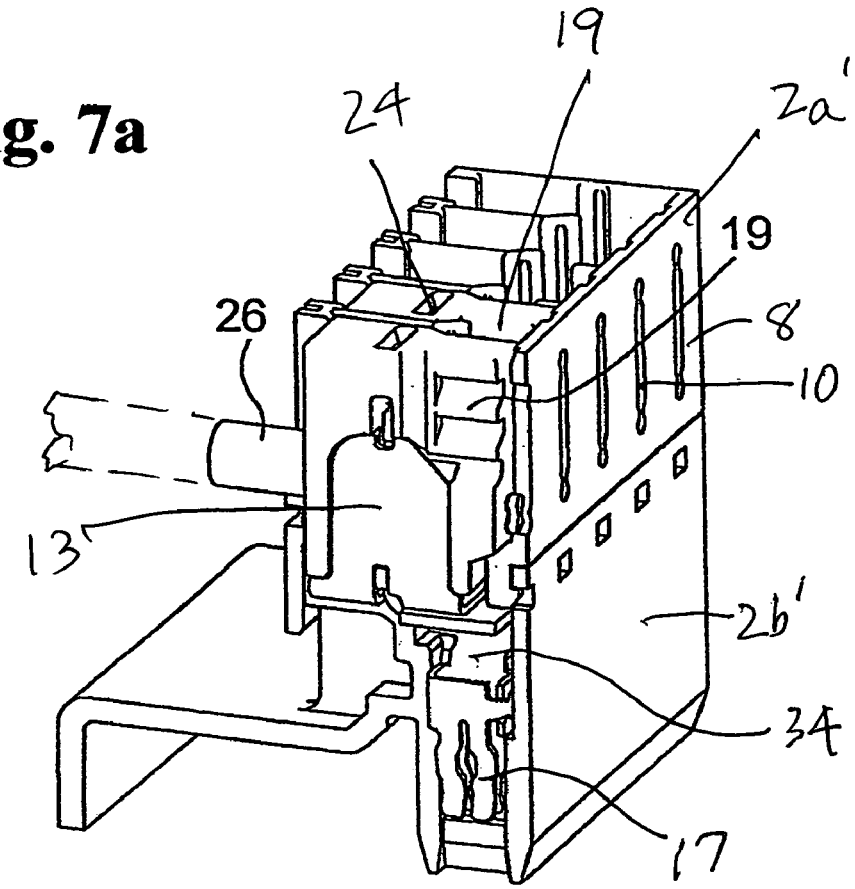
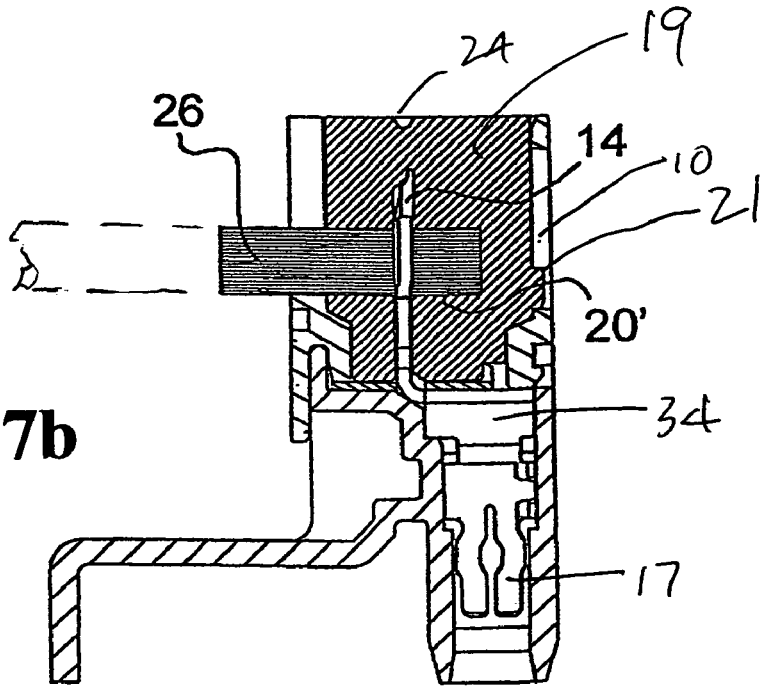
Fig. 7b

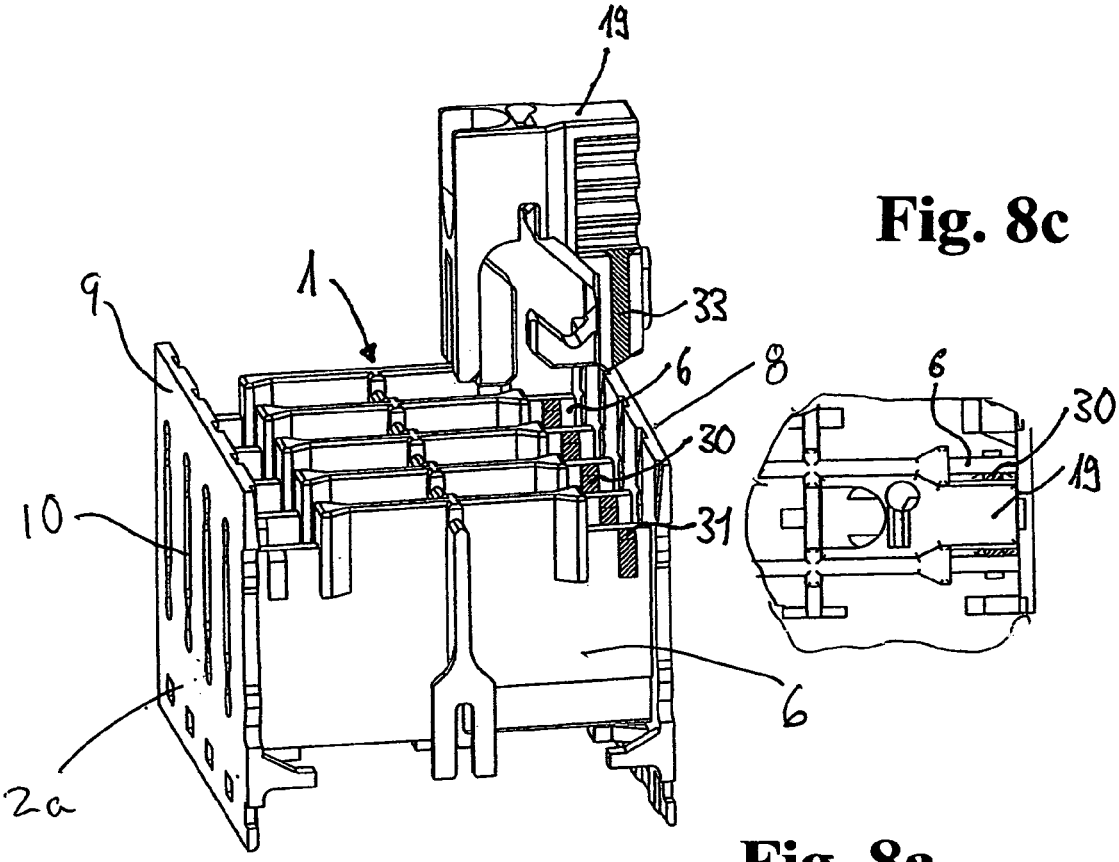
Fig. 8c
Fig. 8a
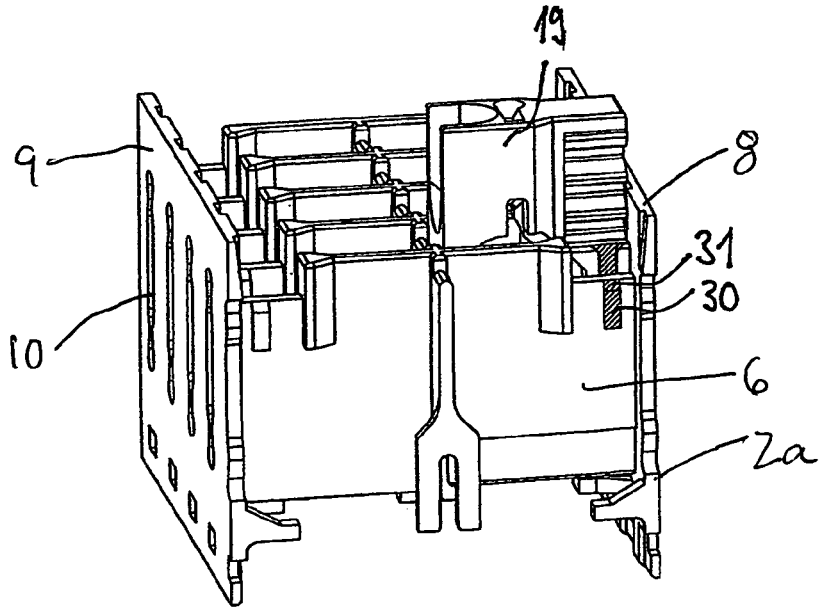
Fig. 8b

CONNECTOR MEANS FOR ELECTRICAL APPARATUS, PARTICULARLY PLUGS

BACKGROUND OF THE INVENTION

A connector arrangement includes a housing containing at least one open-topped chamber in which is mounted stationary upwardly-directed knife means, and a rectangular carrier member arranged for downward insertion within the chamber, thereby to displace an insulated wire supported by the carrier member toward a position in which the knife means pierces the insulation layer and is brought into electrical engagement with the conductor contained therein. The carrier member includes a top surface containing a slot for receiving the tip of an operating tool that displaces the carrier member downwardly in the chamber, and a side wall containing at least one lug and slot arrangement by means of which the carrier member may be displaced upwardly upon lever-like operation of the tool in cooperation with a side wall of the chamber. Preferably, the housing includes a plurality of the chambers arranged in one or more rows. Coding projections on the carrier members and the housing walls insure the insertion of each carrier member only within the proper associated chamber.

DESCRIPTION OF RELATED ART

As evidenced by the prior European patents Nos. EP 0 936 697 A1, EP 1 191 633 A2 and EP 1 191 634 A2, various connector arrangements have been proposed for connecting and disconnecting contacts within electrically insulated housings, wherein movable contact elements are brought into engagement and disengagement with conductors or conductive elements.

In these known devices, an operating tool, especially a screwdriver, is applied on mutually opposite sides of the contact-operating pieces in order to press the conductor into the insulation-piercing contact during connection and to press it out of the contact during disconnection. The direction of movement of the screwdrivers during connection and disconnection is thus offset with respect to these movements by 180°. This type of operation, based on the state of the art, proved to be very good, in particular, because very strong connection and disconnection forces are thus achieved.

It is furthermore known from the German patent No. DE 20 2004 013 363 U1 that one can provide the contact-operating device with a flexible segment, which, for example, can be made in the form of a metal strip and which is guided and diverted in an insulation material housing in such a way that it will be possible to operate the contact-operating piece for connection and disconnection in the same direction, something that facilitates a particularly simple and easily understandable handling of the contact-operating piece or the entire connector block. This procedure, of course, is very simple, but the metal strip requires some additional structural space.

Against this background, the invention was developed to provide a connector Arrangement that will make optimum use of the available construction space, that will be cheap and that will be optimized in terms of structural space and, on top of it all, nevertheless can be handled in an uncomplicated manner.

Accordingly, between the partitions of the connection chambers and the operating elements or between neighboring operating elements, there is provided in each case a slot for the insertion of the tip of a screwdriver, and the operating element has lug areas and recesses, in particular, graduated lug contours against which the operating element can be placed so that it can be levered out of the connection chamber in order to displace a carrier member to disconnect the contact.

The connection of the conductor to the internal knife means is accomplished in a single work step. One or several, for example, three lever movements are normally required to release a conductor for purpose of disconnection. Thus, the releasing operation is somewhat more laborious than the connecting operation. This, however, is balanced out by the extraordinarily compact design and the high reliability of the connector block, which permits a particularly safe connection and disconnection.

Preferably, the operating element contains a conductor-insertion opening, made in the form of a blind hole with an internal conductor stop, which, according to a particular variant, is aligned normal to the direction of operation or the direction of movement of the carrier member operating element and which, according to another particularly compactly structured variant, is at an acute angle to the direction of operation or the direction of movement of the operating element. Preferably, this acute angle is between 20° to 70°, and preferably between 30° to 60°.

Here it is a good idea when the conductor-insertion opening toward the outer surface of the operating element runs into a channel-like or groove-like conductor-receiving area. As the operating element is pressed in, the conductor is placed upon the partition to the neighboring row of connection chambers and thus into the conductor-receiving area. The channel-like or groove-like conductor-receiving area preferably extends parallel to the direction of operation of the operating element and, after contacting the bottom wall of the bore, the conductor is pressed into the conductor-receiving area and protrudes outward from the open side of the connection chamber.

The operating element includes a guide lug that engages a corresponding guide slot contained in one of the partitions that limit the connection chambers, whereby the lug and the slot have corresponding constricted contours, whereby the lug can be locked in one or more positions. As a result, one can easily recognize or feel the disconnected and the connected position and the conductor extraction resistance is increased.

SUMMARY OF THE INVENTION

Accordingly, a primary object of the present invention is to provide a connector assembly including a housing containing at least one open-topped chamber in which is mounted a stationary upwardly-directed knife means, a rectangular carrier member being arranged for downward displacement within the chamber to bring an insulated wire into insulation-piercing electrical engagement with the knife means, thereby to connect the conductor of the insulated wire with an associated output terminal.

According to a more specific object of the invention, the upper surface of the carrier member contains a first slot for receiving the tip of an operating tool, such as a screwdriver, thereby to displace the carrier member and the wire carried thereby downwardly into the chamber relative to the stationary insulation-piercing knife means. A side surface of the carrier member contains at least one second profiled lug and slot arrangement by means of which the carrier member and insulated wire carried may be displaced upwardly in the chamber.

Another object of the invention is to provide a connector assembly wherein a plurality of the chambers are arranged in one or more rows. In one embodiment, the chambers are arranged in a single row and the insulated wires extend horizontally laterally from the connector housing. In this embodiment, the ends of the insulated extend within horizontal bores contained in the end wall surfaces of the carrier member. In a second embodiment, the housing contains a plurality of rows, and the wires extend vertically from the housing. In this embodiment, the ends of the insulated wires extend into bores contained at an acute angle relative to the vertical, with the wires being bent to extend within vertical grooves contained in the end walls of the carrier members.

According to still another object of the invention, coded projections are provided on the side walls of the carrier members and the corresponding chamber walls, thereby to insure that the proper carrier member is inserted into the associated chamber for connection with the appropriate knife means and associated output terminal.

A further object of the invention is to provide a connector assembly including a sectional housing having an upper section containing a plurality of chambers arranged in one or more rows, with a vertically displaceable carrier member being arranged in each chamber for displacing an associated insulated wire downwardly into insulation-piercing engagement with knife means mounted in the chambers, respectively, and a second section carrying the output terminals.

According to another object of the invention, in order to positively guide the carrier member during its vertical displacement relative the to knife means within the chamber, the carrier member is provided at one end with a guide lug that extends within a corresponding vertical guide slot contained in the adjacent side wall of the housing.

BRIEF DESCRIPTION OF THE DRAWINGS

Other objects and advantages of the invention will become apparent from a study of the following specification, when viewed in the light of the accompanying drawing, in which:

FIGS. 3*a* and 3*b* are perspective and transverse sectional views, respectively, of the connector assembly with the carrier member in a partially inserted condition;

FIGS. 4*a* and 4*b* are perspective and transverse sectional views, respectively, of the connector assembly in its fully inserted insulation-piercing position;

FIGS. 7*a* and 7*b* are front perspective and sectional views, respectively, of the apparatus of FIG. 5 in the fully inserted insulation-piercing condition;

FIGS. 8*a* and 8*b* are perspective views illustrating a coding modification of the invention in the exploded and partially-inserted conditions, respectively, and FIG. 8*c* is a detailed top plan view of the carrier member and housing arrangement of FIG. 8*b*.

DETAILED DESCRIPTION OF THE INVENTION

Figure 1:
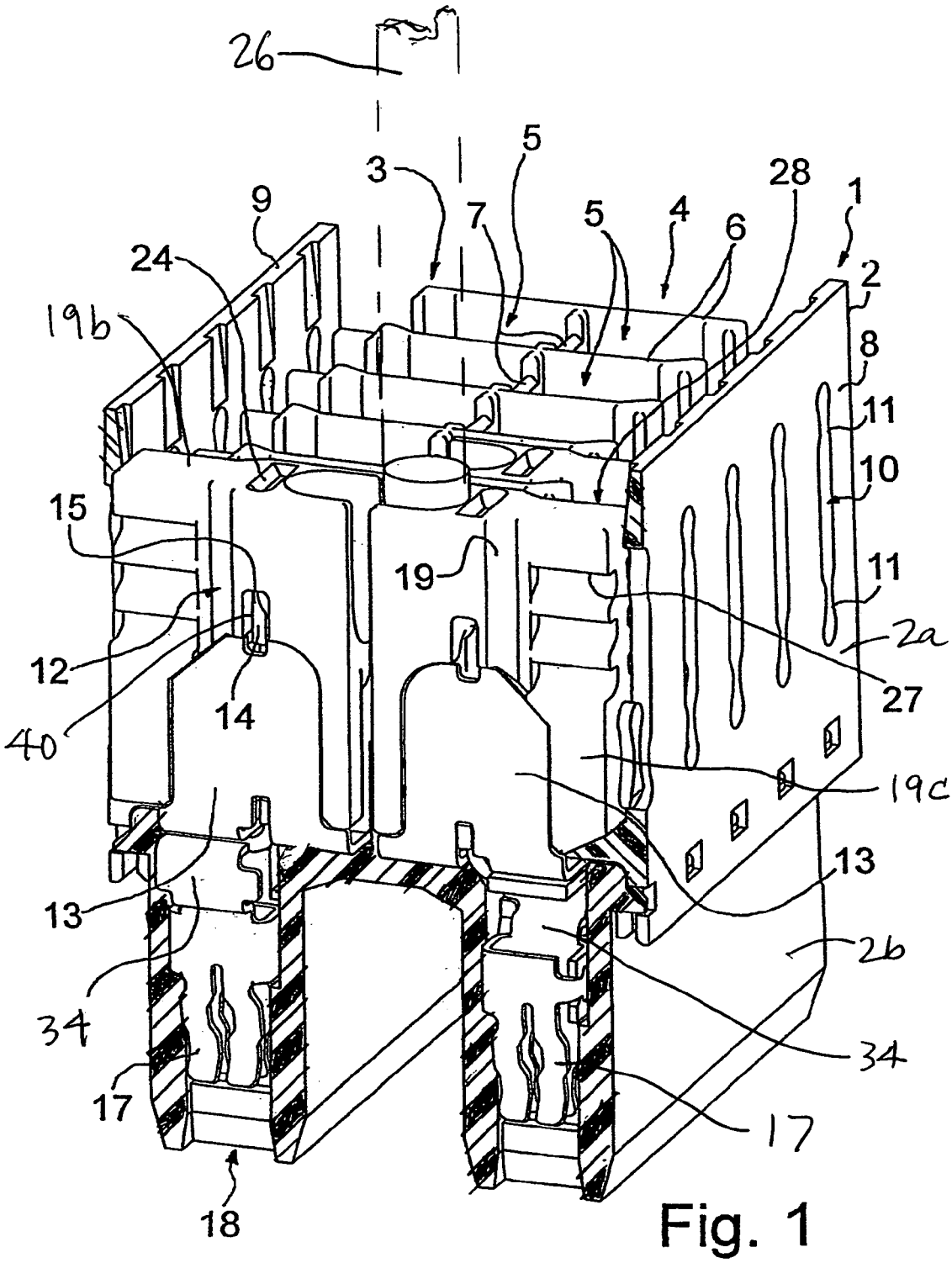
FIG. 1 is a front perspective view of a multiple-row first embodiment of the connector assembly of the present invention.

Referring more particularly to FIGS. 1-4, according to a first embodiment of the invention, the connector assembly 1 includes a sectional housing 2 having an upper section 2*a* that is connected with a lower section 2*b* by means of a conventional snap-fit connection. The upper housing section includes a pair of parallel spaced outer side walls 8 and 9 between which are provided a pair of rows of open-topped vertical chambers 5 defined by inner first walls 6 that extend normal to the side walls, and a plurality of shorter inner walls 7 that extend parallel with the side walls. In accordance with a characterizing feature of the invention, a plurality of rectangular carrier members 19 are provided for vertical displacement in the chambers 5, respectively. Each of the rectangular carrier members includes a vertical first end surface 19*a,* a horizontal top surface 19*b,* a first vertical side wall surface 19*c,* a second vertical end wall surface 19*d,* and a bottom surface containing a vertical slot 40. As shown in FIG. 2*b,* the second end wall surface 19*d* is provided with a vertical guide lug 21 that extends within a corresponding vertical guide slot 10 contained in the adjacent side wall of the upper housing section. A generally U-shaped support member 13 is mounted in the bottom of each of the chambers 5, which U-shaped member 13 includes a horizontal base portion, and a pair of upwardly extending leg portions between which the carrier member is slideably displaced. Also mounted in each chamber 5 is a vertically extending knife means 14 terminating at its upper end in a pair of angularly arranged knife edges 15 (FIG. 2*c*) that are contained within the slot 40. The bifurcated upper leg portions of the knife means 14 are laterally supported between the upper legs of the U-shaped guide members 13. Each of the knife means 14 includes a flexible lower extension 34 that extends downwardly through a corresponding opening contained in the base of the U-shaped guide member 13 and terminates at its lower end tulip-shaped output contact 17 means. The details of the knife means 14 are set forth in the German patent No. DE 20 2004 013 363 U1 referred to above.

Figure 2A:
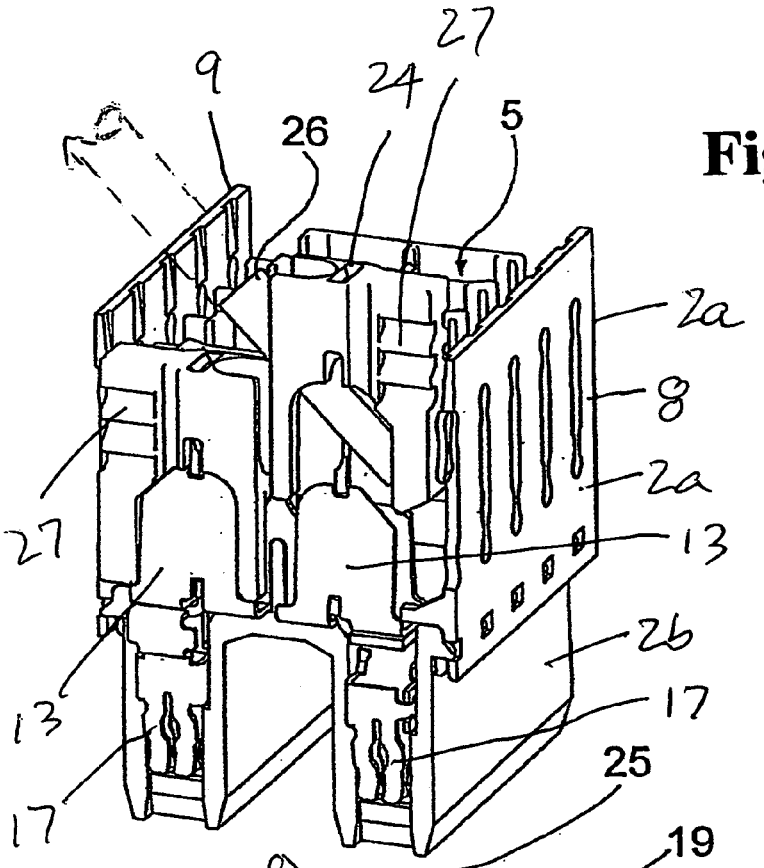
FIGS. 2*a* and 2*b* are front perspective and transverse sectional views, respectively, of the connector assembly in its initial wire-loading position.
Figure 2B:
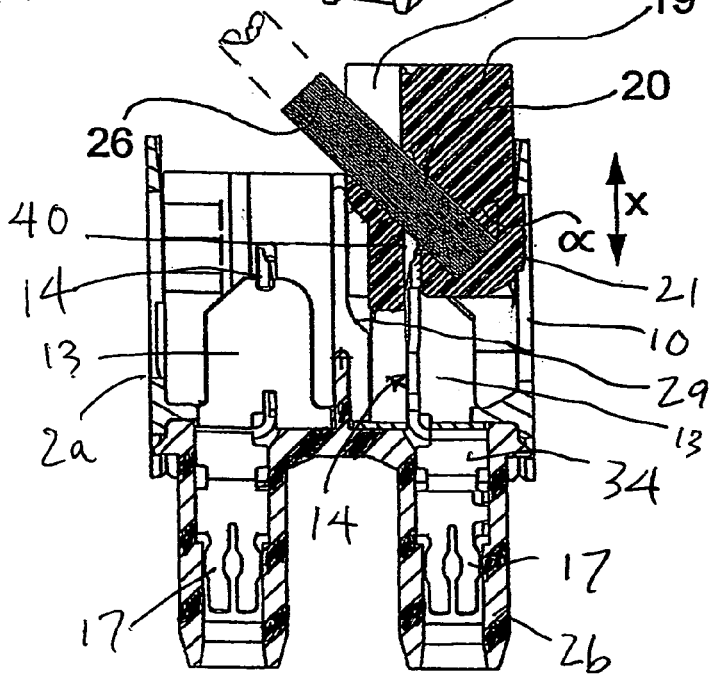
Figure 2C:
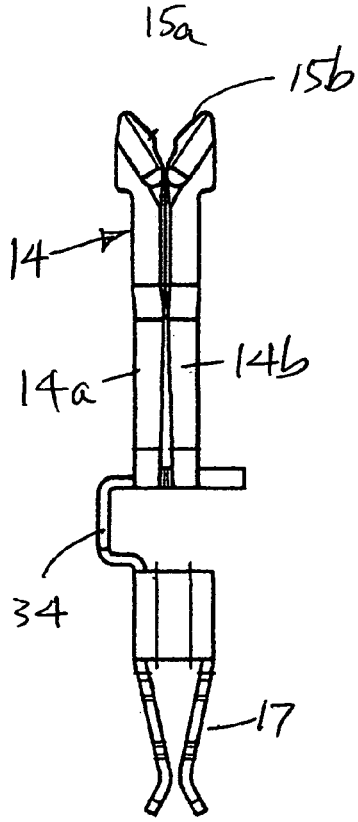
FIG. 2*c* is a side elevation view of the knife means of FIG. 2*b;*

The first end wall portion 19*a* of the carrier member 19 contains a bore 20 for receiving the insulated wire 26, as best shown in FIGS. 2*a* and 2*b*. In this embodiment, the bore 20, which is in communication with the vertical bore 40 contained in the bottom portion of the carrier member, is arranged at an acute angle $\alpha$ to the vertical axis, as shown in FIG. 2*b*. Thus, as will be explained in greater detail below, when the end of the insulated wire 26 is inserted into the bore 20 and the carrier member 19 is displaced downwardly by means of the tip of a screwdriver inserted into the slot 24 contained in the upper surface 19*b* of the carrier member, the insulated wire 26 is displaced downwardly to cause the insulation layer of the wire to be pierced or severed by the knife edges 15 of the knife means 14, thereby to cause the knife means to come into electrical engagement with the inner conductor of the insulated wire. During this downward movement of the carrier member 19 to the intermediate position shown in FIG. 3*b,* the wire 26 engages the upper edge of the associated inner wall 7, whereupon the wire is bent upwardly into the channel 25 contained in the first end surface 19*a* of the carrier member 19, as best shown in FIG.

4*b*. The knife edges 15 of the knife means 14 will now have completely severed the outer layer of insulation of the insulated wire 26. During this downward movement of the carrier member 19, stop surfaces 29 on the inner housing wall 7 are engaged by corresponding stop surfaces 19*e* on the carrier member 19, thereby to prevent further downward movement of the carrier member in the chamber 5.

Figure 9A:
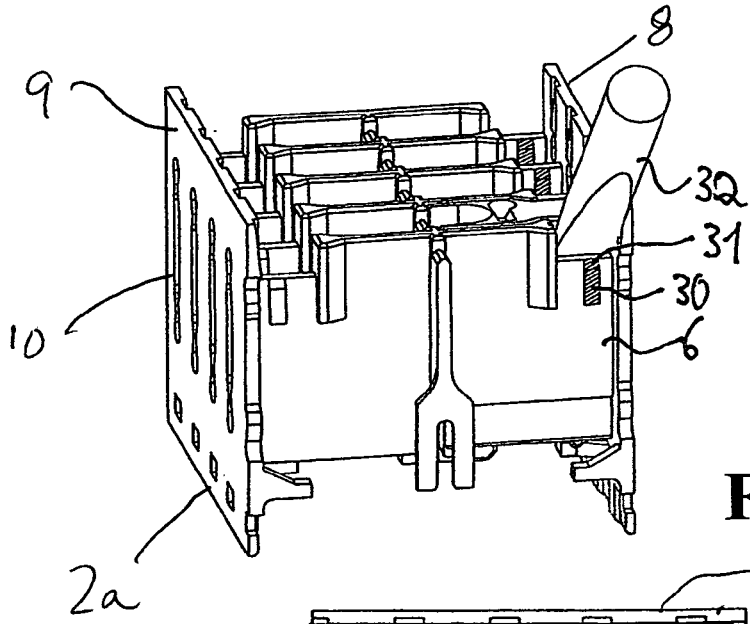
FIGS. 9*a,* 9*b,* and 9*c* are front perspective, top plan and sectional views, respectively, illustrating the lever-like manner in which a tool is used to displace a carrier member upwardly in its chamber.
Figure 9B:
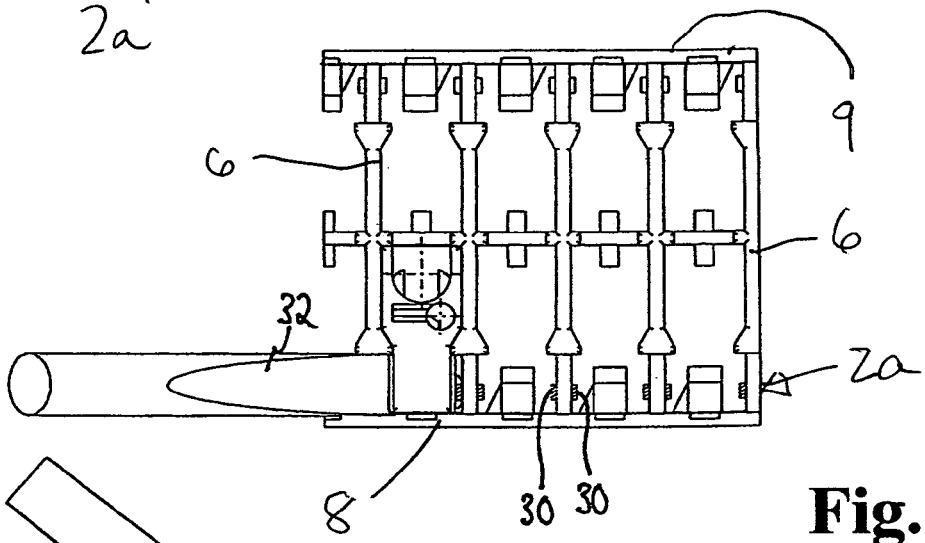
Figure 9C:
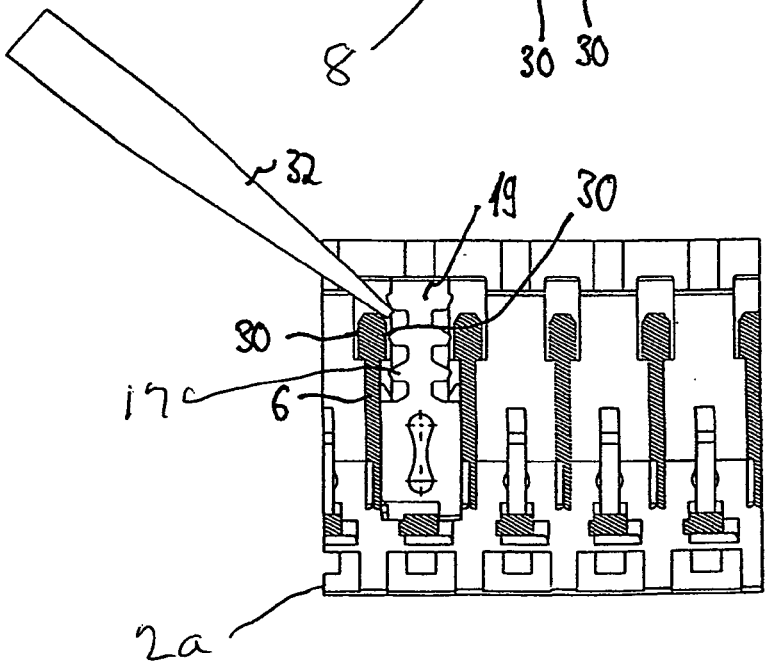

In accordance with an important feature of the invention, the guide slots 10 are provided at their upper and lower ends with constrictions 11 that serve to retain the associated carrier member 19 in either its upper loading position of FIG. 2*b*, or its lowermost conductor-engaging position of FIG. 4*b*. In order to return the carrier member 19 from its conductor-engaging lowermost position of FIG. 4*b* toward the uppermost loading position of FIG. 2*b*, the side wall 19*c* of the carrier member is provided with a plurality of vertically-spaced horizontal profiled lugs and recesses 27 that are arranged to receive the tip of an operating tool, such as a screwdriver. Thus, when the tip of a screwdriver 32 is inserted within the appropriate recess 27 as shown in FIG. 9, the screwdriver may be pivoted in a lever-like manner against a wall surface defined either by a corresponding surface 28 provided at the upper end of an adjacent carrier member, or by the upper edge of the associated transverse inner wall 6. During this downward pivotal lever motion of the screwdriver, the carrier member 29 is displaced upwardly relative to the stationary knife means 14 contained within the inner chamber 5, whereupon the knife means is disengaged from the inner conductor of the insulated wire 26.

Figure 5:
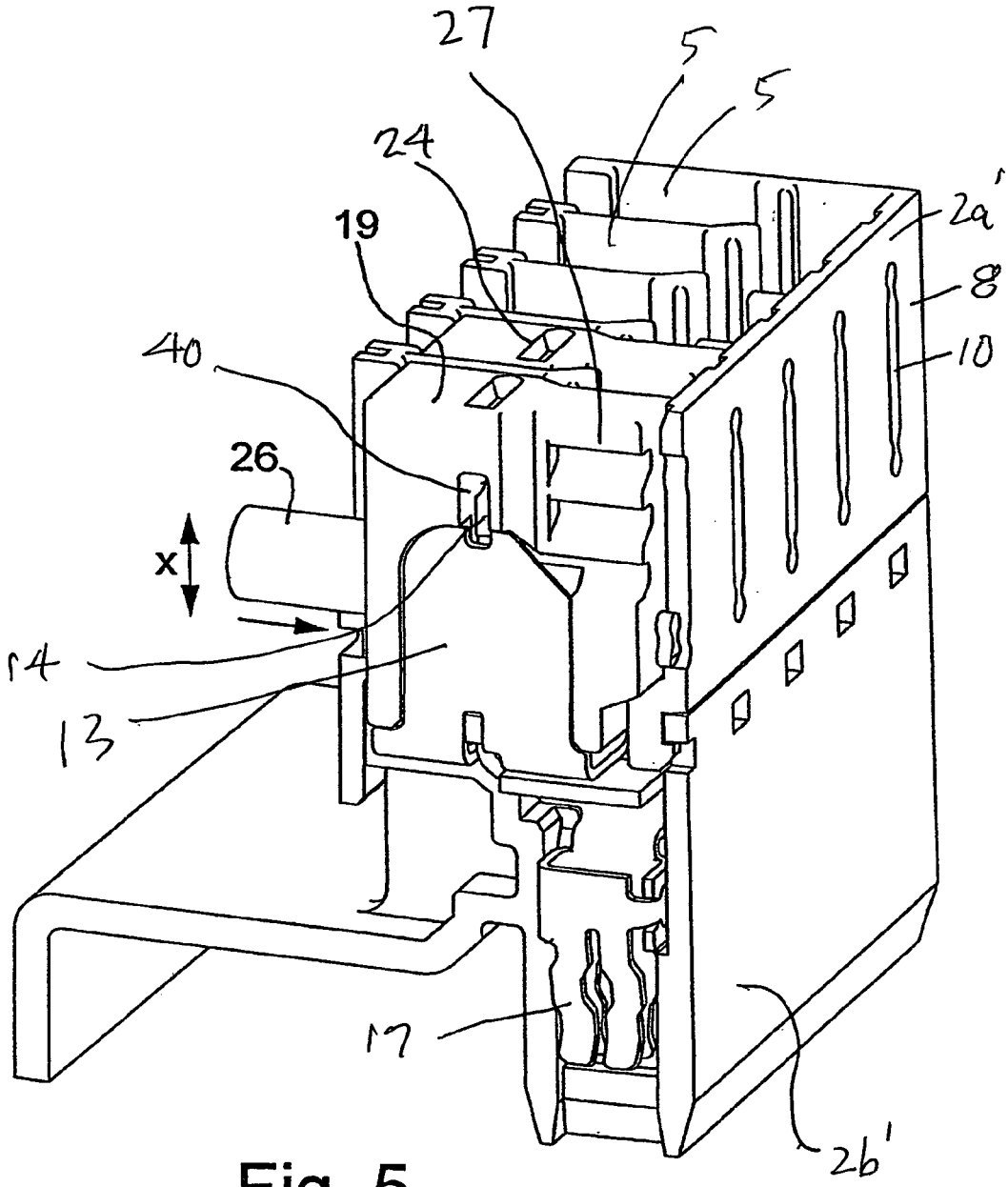
FIG. 5 is a front perspective view, with certain parts broken away, of a single-row second embodiment of the invention.
Figure 6A:
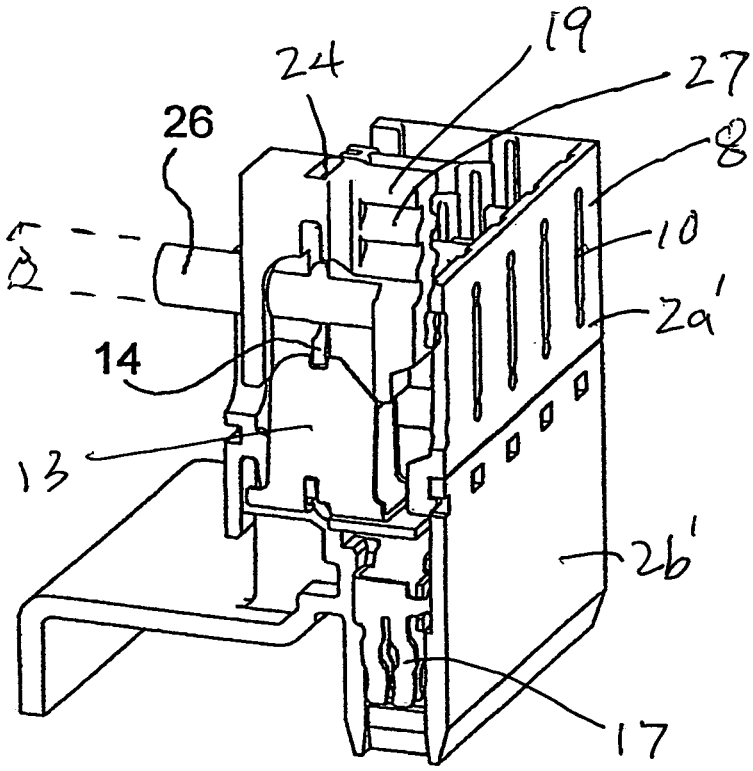
FIGS. 6*a* and 6*b* are front perspective and sectional views, respectively, of the connector assembly of FIG. 5 when in the loading condition.
Figure 6B:
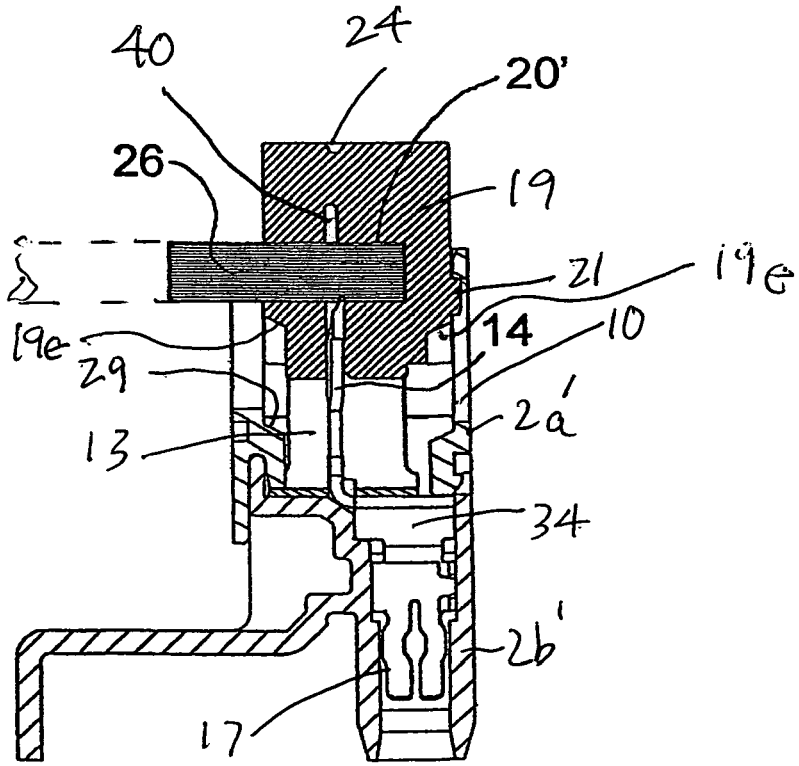

In the modification of the invention illustrated in FIGS. 5-7, the insulated wire 26 extends horizontally into a corresponding horizontal bore 20' contained in the first vertical end surface 19*a* of the carrier member 19. In this embodiment, there is only a single row of the chambers 5 defined in the upper housing section 2*a*. Thus, when the carrier member 19 is displaced downwardly from the loading position of FIG. 6*b* toward the final knife-engaging position of FIG. 7*b*, the knife means 14 penetrates the outer insulation layer of the wire 26, thereby to provide electrical engagement between the conductor and the output contacts 17. As in the previous embodiment, in the embodiment of FIGS. 5-7, the U-shaped guide means 13 serves not only to guide the vertical displacement of the carrier member 19, but also to laterally support the knife means 14 during the penetration of the insulation layer of the wire 26 by the knife edges 15.

Referring now to FIGS. 8 and 9, in accordance with another important feature of the invention, code projections 33 may be provided on the carrier members 19 for cooperation with corresponding code members 30 provided on the inner walls 6, thereby to ensure that the proper carrier member 19 and the associated insulated wire 26 are inserted within the appropriate chamber 5 for connection of the conductors of the insulated wires with the corresponding output terminal means 17.

As indicated previously, in order to displace the carrier members 19 downwardly into the chambers 5 from their elevated loading positions toward their lowermost insulation-piercing engagement positions, the tip of a screwdriver is inserted in the upper slot 24, whereupon the downward force on the screwdriver causes downward displacement of the carrier member. As best shown in FIG. 9, when the tip of the screwdriver is inserted within a recess 27 contained in the side wall of a carrier member 19, a lever action may be applied to the screwdriver to pivot the same about the upper edge of an inner sidewall 6, with the tip of the screwdriver entering the appropriate recess 27, whereupon the downward pivotal movement of the screwdriver affects upward displacement of the carrier member 19, thereby to permit disengagement of the insulated wire 26 from the carrier member.

In both embodiments, the carrier member 19 and the housing sections 2*a* and 2*b* are formed from a durable, electrically-insulating synthetic plastic material, and the knife means 14 is formed from a strip of electrically-conductive sheet metal While in accordance with the provisions of the Patent Statutes the preferred forms and embodiments of the invention have been illustrated and described, it will be apparent to those skilled in the art that changes may be made without deviating from the invention described above.

What is claimed is:

1. A connector assembly for connecting the inner conductor of an insulated wire (26) with an electrical output terminal (17), comprising:

(a) an open-topped rectangular housing (2) including a base, a pair of parallel spaced vertical outer side walls (8, 9) connected with and extending upwardly from said base, and vertical inner wall means (6, 7) defining between said side walls at least one open-topped chamber (5);

(b) stationary knife means (14) mounted in said chamber, said knife means including a pair of spaced upwardly-directed knife edges (14*a*);

(c) output terminal means (17) mounted on said housing outside said chamber;

(d) means (34) electrically connecting said output terminal means with said knife means; and (e) a rectangular carrier member (19) arranged within said chamber for vertical displacement between an upper loading position and a lower knife-engaging position, said carrier member (19) including:

(1) a vertical first end surface (19*a*) containing a bore (30) for receiving one end of the insulated wire when said carrier member is in said upper loading position;

(2) a horizontal top surface (19*b*) containing a first slot (24) for receiving the tip of an operating tool for displacing said carrier member downwardly in said chamber toward said knife engaging position, thereby to cause said knife edges sever the conductor insulation layer and come into direct contact with the electrical conductor;

(3) a vertical first side wall surface (19*c*) containing at least one recess (27) for receiving the tip of a tool that is pivoted against said inner wall means for displacing said carrier member upwardly in said chamber toward said loading position, thereby to permit removal of the insulated wire end from said lateral bore; and (4) a horizontal bottom surface (19*f*) containing a vertical second slot (40) arranged to receive said knife means, said second slot being in communication at its upper end with said bore.

2. A connector assembly as defined in claim 1, wherein said bore (20) has a bottom wall (20*a*) defining a stop.

3. A connector assembly as defined in claim 2, wherein said bore (20) has an axis that is horizontal.

4. A connector assembly as defined in claim 2, wherein said bore (20) has an axis that is inclined at an acute angel (γ) to the vertical.

5. A connector assembly as defined in claim 4, wherein said vertical angle is from between 20° and 70°.

6. A connector assembly as defined in claim 5, wherein said vertical angle is from between 30° to 60°.

7. A connector assembly as defined in claim 2, wherein said carrier member end surface contains a vertical groove (25) extending downwardly from said carrier member top surface and communicating at its lower end with said bore, said vertical groove being such that when said carrier member is displaced downwardly from said loading position toward its knife-engaging position, the insulated wire is bent upwardly by said inner wall means toward a vertical orientation relative to the end portion of said wire that is contained in said bore.

8. A connector assembly as defined in claim 1, wherein said carrier member further includes a vertical second end surface (19*d*) carrying a guide lug portion (21) that extends within a vertical guide slot (10) contained in the adjacent housing side wall, thereby to guide said carrier member for vertical movement relative to said housing.

9. A connector assembly as defined in claim 1, and further including:

(f) a generally U-shaped guide member (13) arranged in the bottom of each of said chambers, said guide member having a horizontal base portion, and a pair of upwardly extending guide leg portions arranged to receive therebetween said carrier member;

(g) and further wherein said knife means are bifurcated and include a pair of vertical knife body portions (14*a*, 14*b*) that are parallel with said housing side walls and which terminate at their upper extremities in knife edges (15*a* and 15*b*), said knife body portions being laterally supported by the leg portions of said U-shaped guide member during the penetration of the insulation layer by said knife edges.

10. A connector arrangement as defined in claim 1, wherein said housing is sectional and includes an upper section (2*a*) carrying said knife means, and a lower section (2*b*) carrying said output terminal means.

11. A connector assembly as defined in claim 1, wherein said inner wall means comprises a plurality of first vertical inner walls (6) that are arranged normal to said housing side walls, and a plurality of second vertical inner walls (7) that extend parallel with said housing side walls.

12. A connector arrangement as defined in claim 11, wherein said inner wall means defines a plurality of rows (3, 4) of said chambers between and extending parallel with said housing side walls.

13. A connector arrangement as defined in claim 12, wherein a plurality of said carrier members are mounted in said chambers, respectively.

14. A connector arrangement as defined in claim 13, wherein said carrier members and said and further including first code projection means (33) arranged on said carrier members for cooperation with corresponding second code projection means (30) on said first inner walls, thereby to insure proper insertion of said carrier members within said chambers, respectively.

15. A connector arrangement as defined in claim 14, wherein said second code projection means have inclined upper surfaces (31).

* * * * *